US006428050B1

(12) United States Patent
Brandley et al.

(10) Patent No.: US 6,428,050 B1
(45) Date of Patent: Aug. 6, 2002

(54) MOTORIZED SKATE

(76) Inventors: Adam K. Brandley, 1585 W. 400 North, Ogden, UT (US) 84404; John R. Irwin, 1105 W. 5575 South, Riverdale, UT (US) 84405

( * ) Notice: Subject to any disclaimer, the term of this patent is extended or adjusted under 35 U.S.C. 154(b) by 0 days.

(21) Appl. No.: 09/212,130

(22) Filed: Dec. 15, 1998

(51) Int. Cl.[7] ..... A63C 17/00
(52) U.S. Cl. ..... 280/809; 280/11.19; 280/816
(58) Field of Search ..... 280/11.19, 11.22, 280/11.23, 11.25, 11.27, 809, 816

(56) References Cited

U.S. PATENT DOCUMENTS 4,454,411 A * 6/1984 Hale et al. ..... 235/95 R
4,546,650 A * 10/1985 Cameron ..... 73/490
4,780,864 A * 10/1988 Houlihan ..... 368/10
5,020,621 A * 6/1991 Martin ..... 180/181
5,048,632 A * 9/1991 Battel ..... 180/181
5,170,161 A * 12/1992 Sakurai ..... 340/870.3
5,177,432 A * 1/1993 Waterhouse et al. ..... 324/166
5,236,058 A * 8/1993 Yamet et al. ..... 180/181
5,330,026 A * 7/1994 Hsu et al. ..... 180/181
5,536,026 A * 7/1996 Pozzobon et al. ..... 280/11.22
5,704,617 A * 1/1998 Stoughton et al. ..... 280/11.2
5,721,539 A * 2/1998 Goetzl ..... 340/870.3
5,829,543 A * 11/1998 Diaz ..... 180/181
5,868,404 A * 2/1999 Montague ..... 280/11.2
5,929,335 A * 7/1999 Carter ..... 73/493
6,050,357 A * 4/2000 Staelin et al. ..... 180/65.1

* cited by examiner

*Primary Examiner*—J. J. Swann
*Assistant Examiner*—L. Lum
(74) *Attorney, Agent, or Firm*—Thompson E. Fehr

(57) ABSTRACT

A motorized skate employing an electric motor with rotor being a drive wheel. A boot or clamp for holding the foot of a user is attached to a rail that supports the boot or clamp. The drive wheel has one or more permanent magnets attached to said drive wheel with opposite magnetic poles adjacent to one another. One or more electromagnets are attached to the rail to which the drive wheel is rotatably connected. A sensor determines the location of the permanent magnets. This information is utilized to assure that the electromagnets are energized only when the resultant magnetic fields will interact with the magnetic fields of the permanent magnet to produce a force on the drive wheel that will cause rotation in the desired direction. Three principal embodiments are employed. In a first embodiment, a computer periodically activates a switch to send pulsed voltage to the electromagnets; the percentage of the period of each pulse during which the voltage is non-zero determines the speed of the drive wheel. In a second embodiment, the computer is replaced with a timing circuit that controls the switch. And in a third embodiment, the output from the sensor directly controls the switch. A remote control can regulate the operational parameters of the skate and display both the selected and current levels for such parameters.

115 Claims, 4 Drawing Sheets

MOTORIZED SKATE

BACKGROUND OF THE INVENTION

1. Field of the Invention

This invention relates to a skate powered by a motor in which the rotor also functions as a drive wheel of the skate.

2. Description of the Related Art

The prior art in the United States includes eight patents for motorized skates and one patent for a motorized skateboard.

In U.S. Pat. No. 823,385 the skate has a gear-drive motor attached to the rear wheel of the skate, with a bevel-pinion which meshes with a bevel-gear on the front wheel. It utilizes a gasoline motor having a carburetor.

The skate of U.S. Pat. No. 854,299 utilizes pneumatic tires which are chain driven by an internal combustion motor. Ratchets prevent the wheels from moving in a reverse direction. A belt to be worn by the user has control cords, which simply transmit a mechanical force when pulled by the user, for the motor.

U.S. Pat. No. 1,672,700 discloses, but does not claim, skates whose wheels are powered by an electric motor. The electric motor is attached to the heel of the skate and drives the rear wheels through a train of reduction gears. A rheostat or similar device controls the speed of the motor. The battery and rheostat are worn about the waist of the user and are connected by wires to the motor.

The skates covered by U.S. Pat. No. 2,857,008 have rear wheels which are powered through a flexible drive shaft by a gasoline motor power pack worn on the back of the user. Control means consist of a hand-held unit having wires for the throttle, clutch, and ignition. (The wires for the throttle and clutch simply transmit magnetic forces; the wire for the ignition electrical grounds and, therefore, deactivates the motor in the power pack.) The skate can only be driven in a forward direction.

The device of U.S. Pat. No. 3,876,032 may utilize either standard wheels or wheels inside an endless belt that contacts the surface on which the skating is to be done. An electric motor is mounted on the skates and is connected to the drive wheels by "any standard type of speed changing linkage," such as a chain and sprocket mechanism or a series of gears (spur gear trains). A battery and switches to control speed are worn by the user and are wired to the motor.

Covered by U.S. Pat. No. 4,546,841 is a device having an internal combustion engine to be worn by the user. A flexible drive shaft from the engine is connected, by a releasable clutch, to the driving shaft that powers the rear wheels of the skate. When the clutch is released, the skates function as normal, non-powered skates.

U.S. Pat. No. 5,048,632 involves an extremely complicated device and may be either a motor-driven skate or a ski propelled by a belt driven by a motor. The motor is connected to the wheels or belt with a bevel gear device through either a Cardan or flexible coupling transmission which permit movement in one direction only. Power for the motor is generated by a system away from the skates, which includes a thermal engine and an electric, pneumatic, hydraulic, or equivalent power generator; there is also a power storage reservoir. Steering is accomplished through an elaborate deformable parallelogram system. A braking system and a remote control are, also, employed, as additionally is a variator for varying the speed of the wheels or the belt. Very few details are provided for the remote control; the patent essentially only states, in line 41 through line 45 of column 1, with reference to the remote control means, "These means being essentially an electronic, electric, hydraulic or equivalent regulation device; overload and overpressure release devices and an order control and transmitting means actuated, manually."

And an internal combustion engine is attached to a skate in the invention of U.S. Pat. No. 5,236,058. The engine may be coupled to a drive wheel by a vee belt pulley, a worm drive, a gearing system, or a chain drive. A friction clutch is optionally disclosed. Brakes are operated by depressing a toe plate. When no clutch is employed, the skater begins skating under muscle power until a desired speed is attained; this causes the engine to rotate so that it will begin operating when fuel is introduced into it. If desired, an auxiliary wheel, rather than a drive wheel, can be utilized for this purpose. A wired or wireless remote control is also disclosed; but, again, few details are given concerning the remote control.

The patent applying to a motorized skateboard is U.S. Pat. No. 5,020,621. An electric motor is attached to the bottom of a skateboard. The disclosure asserts that the motor is connected to a drive wheel of the skateboard with a belt, tooth belt, chain, direct engine drive, geared drive, friction drive, or angle gear drive, although only a pulley which is compressed into a channel in the drive wheel through pressure from the surface on which the skateboard is being ridden is claimed. A rheostat may govern the speed of the engine. The motor may be activated and deactivated through a hand-held transmitter which communicates with a receiver connected to the motor.

It should, moreover, be noted that none of the preceding patents indicated that the skate or skateboard could optionally be operated in a forward direction or a reverse direction.

SUMMARY OF THE INVENTION

The Motorized Skate of the present invention utilizes an electric motor wherein the rotor of such electric motor also serves as the drive wheel of the Motorized Skate. Preferably such electric motor is the Electric Motor with Rotor Being a Drive Wheel which is the subject of the United States patent application entitled "Electric Motor with Rotor Being a Drive Wheel," which is owned by the owner of the present patent application, and which has been filed with the United States Patent and Trademark Office on the same date as the present application. The application for the "Electric Motor with Rotor Being a Drive Wheel" is hereby incorporated by reference within the present patent application.

And even more preferably, such electric motor utilizes the first method for controlling the speed of the drive wheel which is described in the United States patent application entitled "Electric Motor with Rotor Being a Drive Wheel."

The rail which supports the foot of the user and also supports the axle for each wheel of the skate. Such rail, thus, serves as the structure that supports the axle for the drive wheel has attached to such rail one or more electromagnets for each drive wheel in the United States patent application entitled "Electric Motor with Rotor Being a Drive Wheel." The electric motors are otherwise constructed and function as described in the United States patent application entitled "Electric Motor with Rotor Being a Drive Wheel."

Preferably, when the first method for controlling the speed of the drive wheel which is described in the United States patent application entitled "Electric Motor with Rotor Being a Drive Wheel" is employed, a single computer controls all the electric motors on a skate. Each electric motor or any combination of electric motors can, however, be controlled by a separate computer.

With the first method, each computer receives commands from a remote control which communicates with the computer by wire, by fibre-optic cable, by electromagnetic waves (preferably, radio frequency waves), by ultrasonic signals sent through the air, by utilizing the body of the user as a medium for transmission of a radio frequency wave, or by any other method for sending signals containing information that is well known in the art. When the second method for controlling speed is employed, the remote control can only transmit signals, as described above, for controlling the speed and for reversing the direction of the drive wheels. (As with the computer, a single timing circuit can be utilized for any combination of the electric motors on a given skate but preferably controls all such electric motors.) But when the third method is utilized, only reversal of direction can be accomplished with the remote control.

Preferably when the first method for controlling the speed of the drive wheels is utilized, the remote control also receives signals from the computer and displays the information contained within such signals. Such information may, for example, include the speed of the skates, the distance traveled, the rotational speed of the drive wheel, and the remaining time for which the battery will have sufficient charge to power the skate.

Also, preferably, the remote control separately controls each of two skates so that, for example, one skate can run forward and simultaneously the other skate can run backward to facilitate a user's pointing the user's toes in generally opposite directions and skating in a circle.

And preferably, the structure that supports the axle for the drive wheel contains a cavity that communicates with the electromagnets and can contain either a heat-transfer medium or a heat-absorbing medium to reduce heat near the electromagnets. When a heat-transfer medium is to be employed, the cavity also communicates with at least one radiating surface, such radiating surface preferably being either composed of carbon-filled nylon plastic or a metal fin.

Optionally, the electromagnets are encapsulated within a module having at least one radiating surface, such radiating surface preferably being either metal fins or fins composed of a carbon-filled nylon plastic. The module is removably inserted into the structure that supports the axle for the drive wheel. Within a cavity of the module is placed a heat-transfer medium (a fluid or gel) which communicates with both the electromagnets and the radiating surface, thereby conducting heat from the electromagnets to the radiating surface, from which such heat is transferred to the surrounding environment.

Moreover, in a still further alternative, the electromagnets can either simply be air cooled or may have liquid circulated between such electromagnets and a radiating heat sink through tubes. When the tubes are utilized, a unique magnetic pump is employed that is operated by a magnetic connecting between the rotating permanent magnets and a permanent magnet located in the impeller of the pump. And air cooling may be aided by the attachment of a fan to the structure that supports the axle for the drive wheel.

Therefore, cooling of the electric motors occurs just as in the United States patent application entitled "Electric Motor with Rotor Being a Drive Wheel."

DESCRIPTION OF THE PREFERRED EMBODIMENT

Figure 1:
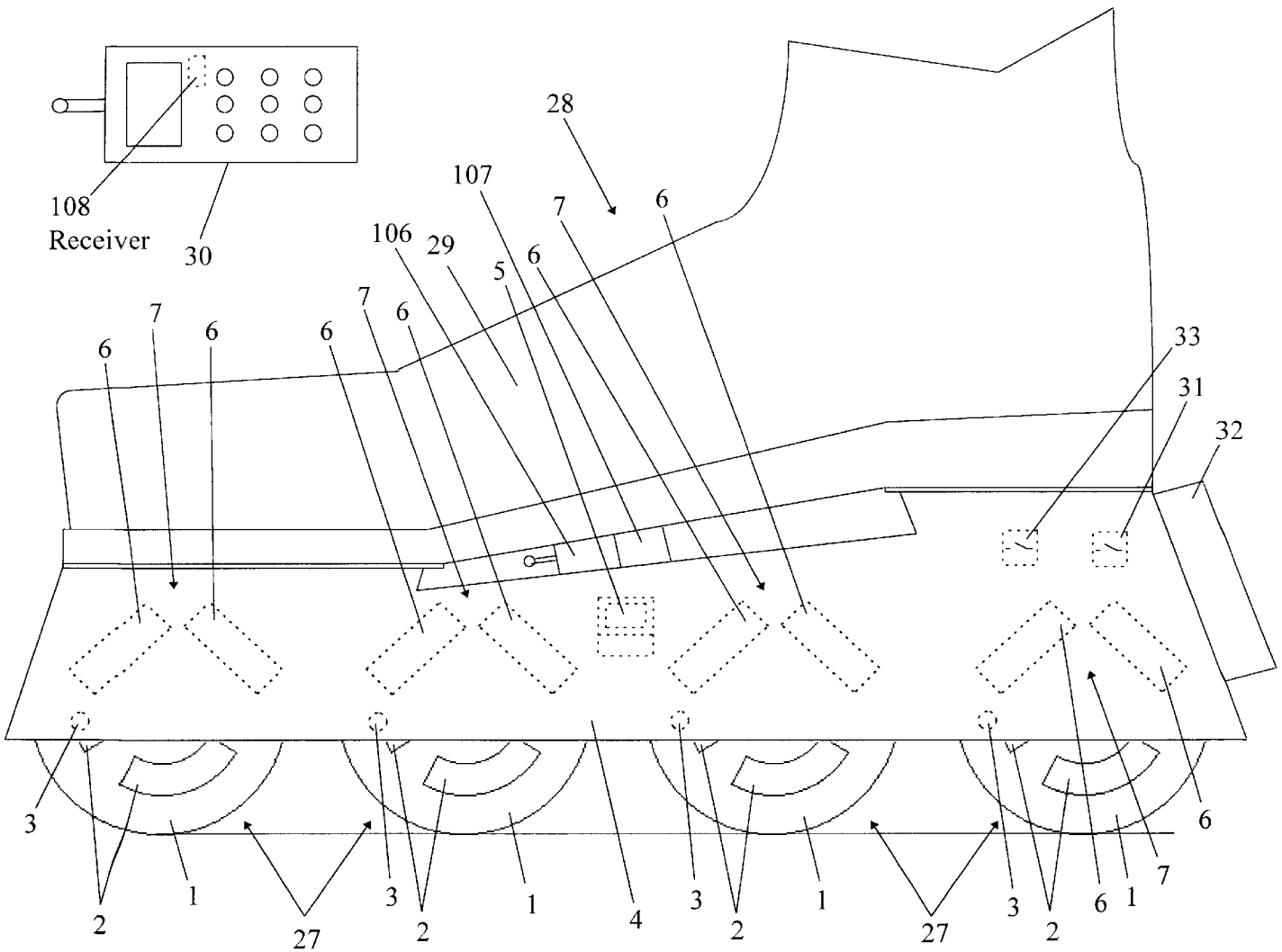
FIG. 1 illustrates the Motorized Skate where a computer is employed to control the speed of the drive wheels.

As stated above, the Motorized Skate of the present invention utilizes an Electric Motor with Rotor Being a Drive Wheel which is the subject of the United States patent application entitled "Electric Motor with Rotor Being a Drive Wheel," which is owned by the owner of the present patent application, and which has been filed with the United States Patent and Trademark Office on the same date as the present application. The application for the "Electric Motor with Rotor Being a Drive Wheel" is hereby incorporated by reference within the present patent application.

The Electric Motor with Rotor Being a Drive Wheel 27, which for simplicity will hereinafter be termed the Electric Motor 27, provides power to one or more drive wheels 1 of the skate 28, as illustrated in FIG. 1, FIG. 2, FIG. 3, and FIG. 4 of the present patent application. The rail 4 of the skate 28 both serves as the structure 4 to which the axle of the drive wheel 1 is rotatably attached and provides the requisite support for the portion 29 of the skate 28 (either a clasp or a boot) which retains the foot of a user and which is attached to the rail 4. The Electric Motors 27 are otherwise constructed and function as described in the United States patent application entitled "Electric Motor with Rotor Being a Drive Wheel."

Preferably, as discussed above, when the first method for controlling the speed of the drive wheel 1 which is described in the United States patent application entitled "Electric Motor with Rotor Being a Drive Wheel" is employed, a single computer 5, as illustrated in FIG. 1 of the present patent application, receives information from the sensors 3 for all the Electric Motors 27 on a given skate and activates the electromagnets 6 of each such Electric Motor 27, although each Electric Motor 27 or any combination of Electric Motors 27 can be controlled by a separate computer 5.

A remote control 30 communicates with each computer 5 through a receiver 106. (Of course, if a wire is used for communication between the remote control 30 and each computer 5, such wire simply connects the remote control 30 to each computer 5 and thereby replaces the receiver 106.) Moreover, a single remote control 30 can preferably communicate with two skates 28. (Encoded signals, using for encoding any method that is well known in the art, can direct a signal to a particular computer 5 or to all the computers 5 associated with a particular skate 28. When a user utilizes more than one skate 28, as is customary, the encoded signals assure that each skate is, if desired, controlled separately.)

The user enters into the remote control 30, by any method that is well known in the art, the desired (selected) values for the operational parameters of the Motorized Skate, e.g., a given motor speed, a given direction for a particular skate 28 (forward or backward), or a given angular velocity for a particular Electric Motor 27. The remote control 30 then transmits an appropriate signal to the computers 5 by wire, by fibre-optic cable, by electromagnetic waves (preferably, radio frequency waves) broadcast through the air, by ultrasonic signals sent through the air, by utilizing the body of the user as a medium for transmission of a radio frequency wave, or by any other method for sending signals containing information that is well known in the art.

Figure 4:
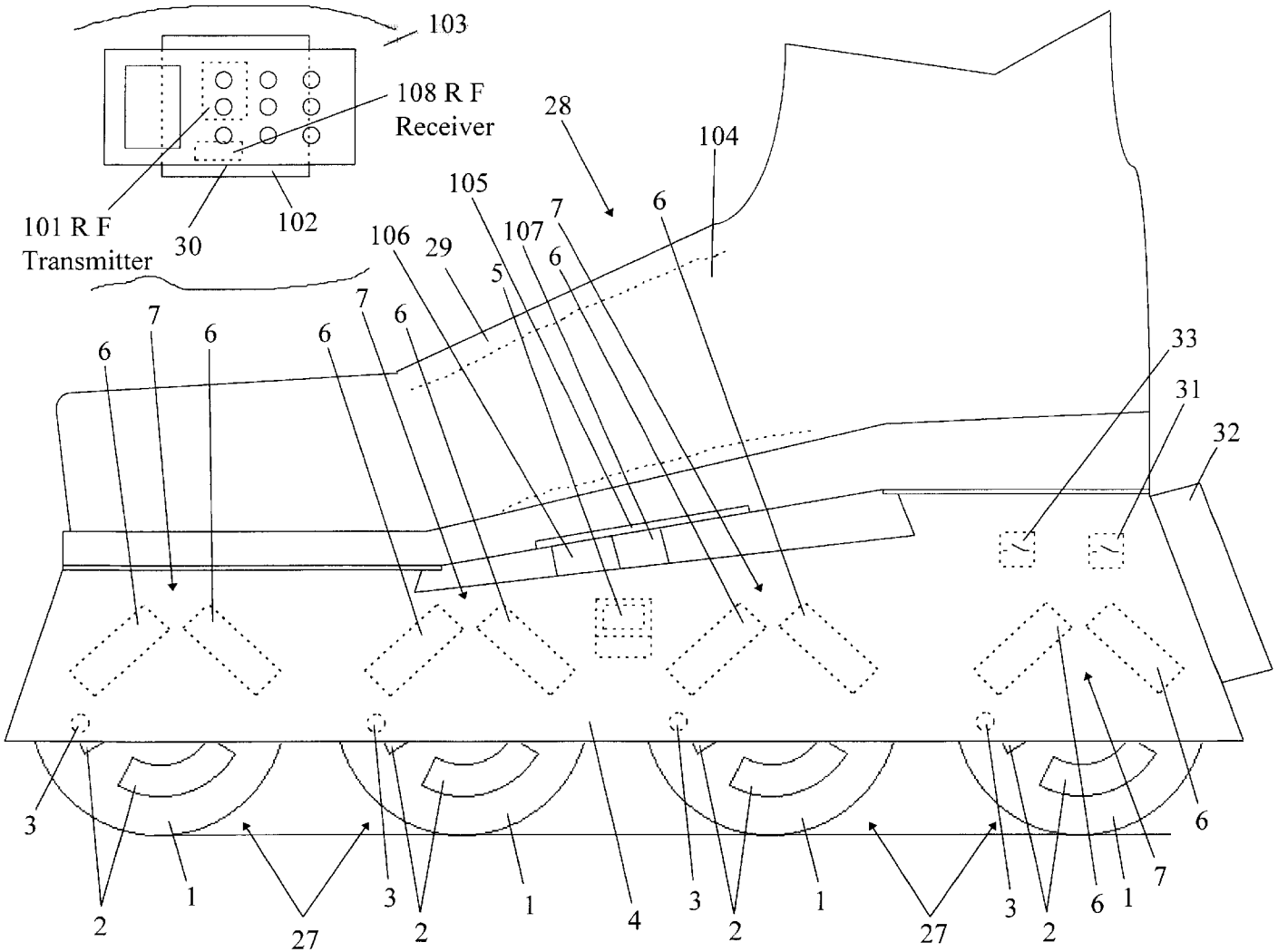
FIG. 4 portrays, in the embodiment of FIG. 1, the system utilized to employ the body of the user as a medium for transmission of a radio frequency wave.

In order to utilize the body of the user as a medium for transmission of a radio frequency wave, the remote control 30 includes, as portrayed in FIG. 4 of the present patent application, a radio frequency transmitter 101 that is electrically connected to a conductor 102, which conductor functions as an electrode plate and is preferably wide, such as a plate of conductive foil. The conductor 102 is located near the skin of the user, preferably the user's hand 103. Near the skin, preferably the foot 104, of the user is a conductor 105 similar to conductor 102, which is electrically connected to a radio frequency receiver 106 that communicates with the computer 5. Since skin has less resistance to electromagnetic radiation than does air, the radio frequency wave will travel through the body of the user from conductor 102 to conductor 105 by capacitive coupling. The greater the surface areas of conductors 102 and 105 are, the stronger will be the signals that are transmitted between the conductors 102 and 105.

The appropriate computers 5 receive the signal that has been transmitted in one of the ways described above and then function as described in the United States patent application entitled "Electric Motor with Rotor Being a Drive Wheel."

Figure 2:
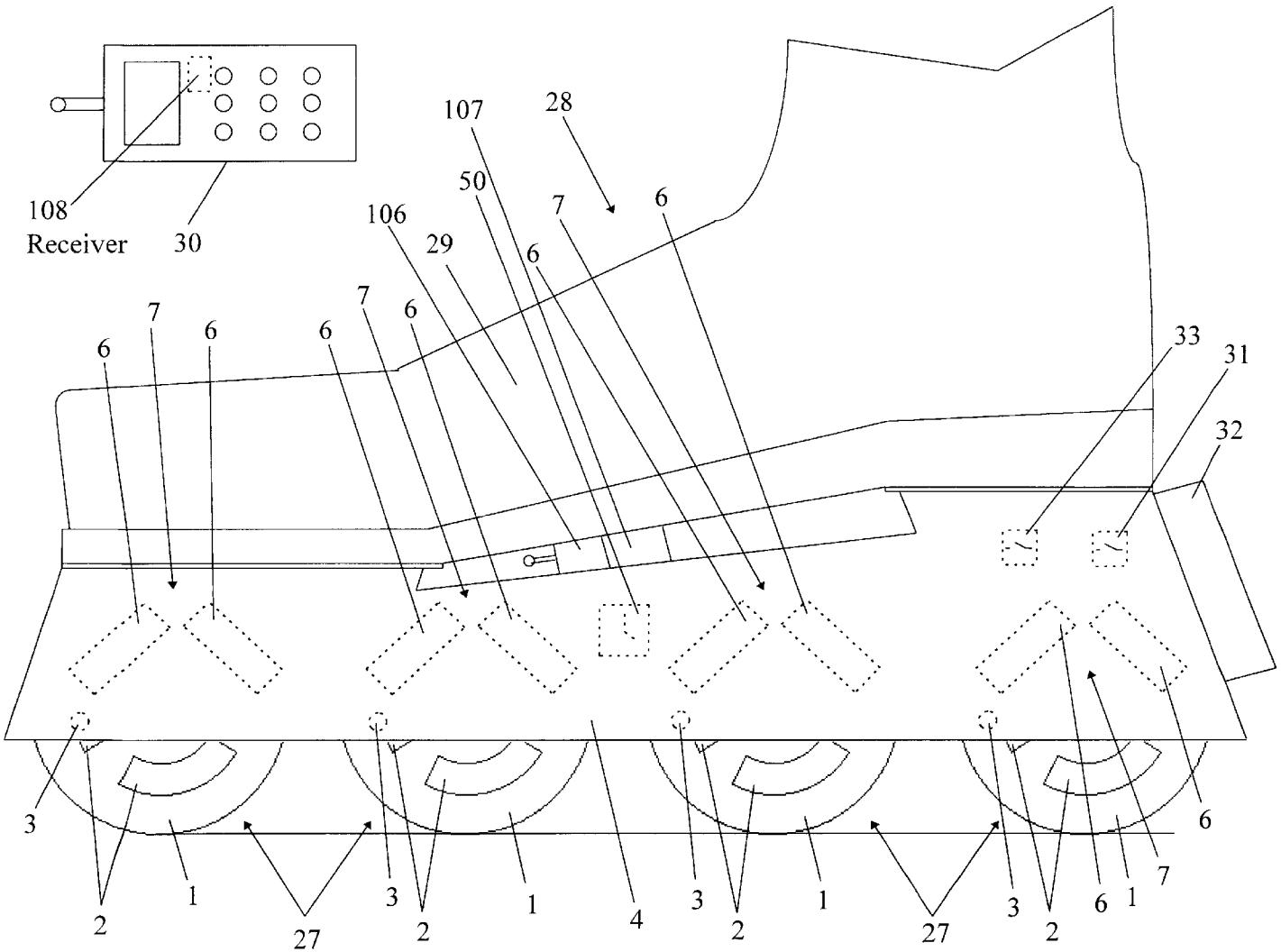
FIG. 2 shows the Motorized Skate using a timing circuit to control the speed of the drive wheels.

When the second method for controlling the speed of the drive wheel 1 is employed, the remote control 30 communicates, as portrayed in FIG. 2 of the present patent application, with the timing circuit 50 (since the timing circuit 50 simply replaces the computer 5 as compared to the embodiment for utilizing the first method for controlling the speed of the drive wheel 1) through an appropriate receiver 106 (if a wire is used for communication between the remote control 30 and the timing circuit 50, such wire simply connects the remote control 30 to the timing circuit 50 and thereby replaces the receiver 106.) both to adjust electronically (by any method that is well known in the art, such as changing the value of a potentiometer) the proportion of the period during which such timing circuit 50 produces an output voltage, in order to control the speed of the skate 28, and with any means that is well known in the art, preferably an electronic means, to insert an inverter, additional switches, or an H-bridge 33, if desired, to reverse the direction of rotation for the drive wheel 1 as described in the United States patent application entitled "Electric Motor with Rotor Being a Drive Wheel."

Adjusting the proportion of the period during which the timing circuit 50 produces an output voltage and using an inverter, the additional switches, or an H-bridge 33 to cause the drive wheel 1 to rotate in a reverse direction could, alternatively, be accomplished manually through any means that is well known in the art, such as mechanically flipping the additional switches 33, mechanically flipping switches to insert electrically the inverter or the H-bridge, or mechanically rotating the knob of a potentiometer.

Figure 3:
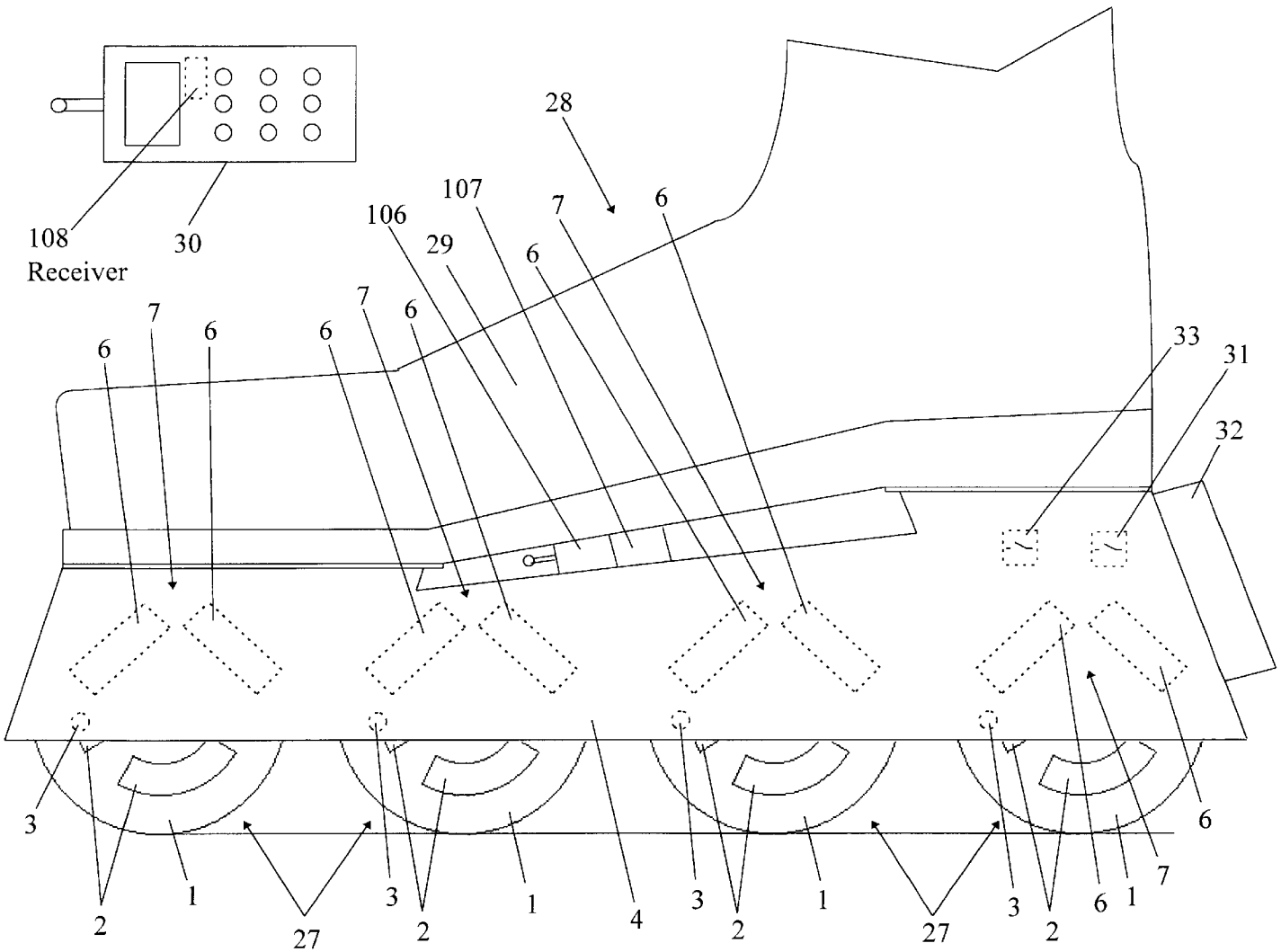
FIG. 3 depicts the Motorized Skate when only a switch or switches are utilized to connect the source of electrical energy to the electromagnets.

When the third method described in the United States patent application entitled "Electric Motor with Rotor Being a Drive Wheel" is utilized, the speed of the skate 28 cannot be adjusted; but the drive wheel 1 can be caused to rotate in a reverse direction through the same techniques as explained above for the second method except that the remote control 30 must communicate directly with the insertion means, because there would be no timing circuit 50 with which the insertion means is associated. FIG. 3 of the present patent application illustrates this embodiment.

The preferred source of electrical energy 32 to operate the Electric Motor 27 is a rechargeable battery pack.

Preferably, the remote control 30 also utilizes any method that is well known in the art (such as a liquid crystal display or light emitting diodes) to show both the selected values for the operational parameters and the current status for such operational parameters of the Motorized Skate, e.g., speed of the skate 28, the distance traveled, the rotational speed of the drive wheel 1, and the remaining time for which a rechargeable battery pack 32 will have sufficient charge to power the skate 28. Of course, to be able to provide such remaining time, a computer 5 is electrically connected to the rechargeable battery pack 32. And the computer 5 is programmed to determine the other operational parameters from the information provided by the sensors 3. (This display option is available only when a computer 5 is employed.)

To provide the information to be displayed, the computers 5 are appropriately programmed, by any manner that is well known in the art, and communicate with the remote control 30 in the same manner used the remote control 30 to transmit a signal to the computers 5. In the case of transmission through the body of the user, however, each computer 5 or timing circuit 50 must communicate with a radio frequency transmitter 107 connected to the conductor 105; and the remote control 30 must also include a radio frequency receiver 108 attached to the conductor 102 which communicates with the mechanisms in the remote control 30 that produce the desired display. In other cases (except when communication between the remote control 30 and the computer 5 is accomplished by wire or cable), a transmitter 107 must communicate with the computer 5; and the remote control 30 must also include a receiver 108 which communicates with the mechanisms in the remote control 30 that produce the desired display.

Preferably, as discussed above and as depicted in FIG. 17 of the patent application entitled "Electric Motor with Rotor Being a Drive Wheel," the structure 4 that supports the axle for the drive wheel 1 contains a cavity 34 that communicates with the electromagnets 6 and can contain either a heat-transfer medium 35 or a heat-absorbing medium 35 to reduce heat near the electromagnets 6. When a heat-transfer medium 35 is to be employed, the cavity 34 also communicates with at least one radiating surface 36, such radiating surface 36 preferably either being composed of carbon-filled nylon plastic or comprising a fin made of metal. Examples of heat-transfer media 35 are antifreeze and heat sink compound. Examples of heat-transfer media 35 or heat-absorbing media 35 are wax; plastic-encapsulated wax spheres such as those sold under the trade name THERMA-SORB® by Frisby Technologies, Inc. of Winston-Salem, N.C.; and such plastic-encapsulated wax spheres mixed into mineral oil. Of these examples, it has been experimentally determined that heat sink compound performs most satisfactorily.

Optionally and again as considered above, as shown in FIG. 7 of the patent application entitled "Electric Motor with Rotor Being a Drive Wheel," the electromagnets 6 are encapsulated within a module 10 having a radiating surface, preferably metal (or carbon-filled nylon plastic) fins, 11. The module 10 is removably inserted into the rail 4 of the skate 28. Within a cavity 37 of the module 10 is placed a heat-transfer medium 12 (a gel or fluid 12) which communicates with both the electromagnets 6 and the metal fins 11, thereby conducting heat from the electromagnets 6 to the fins 11, from which such heat is transferred to the surrounding environment.

Moreover, in a still further alternative, the electromagnets 6 can either simply be air cooled or may have liquid circulated between such electromagnets 6 and a radiating heat sink 13, as illustrated in FIG. 8 of the patent application entitled "electric motor with rotor being a drive wheel."

If the electromagnets 6 are liquid cooled, the liquid cooling fluid 14 is—as shown in FIG. 3, FIG. 5, FIG. 6, FIG.

8, FIG. 10, FIG. 11, FIG. 12, FIG. 14, FIG. 15, and FIG. 16 of the patent application entitled "electric motor with rotor being a drive wheel"—preferably pumped by means of a magnetic pump 15 as described in the patent application entitled "electric motor with rotor being a drive wheel."

We claim:

1. A motorized skate, which comprises:

a means for retaining a foot of a user;

a drive wheel;

a rail to which said drive wheel is rotatably attached and to which said foot retaining means is attached;

one or more permanent magnets attached to said drive wheel with opposite magnetic poles adjacent to one another;

one or more electromagnets attached to said rail and arranged generally in a plane that is substantially parallel to each plane containing said permanent magnets, said electromagnets being sufficiently close to said permanent magnets that magnetic fields of said electromagnets and said permanent magnets will interact with one another;

a sensor that produces a signal only so long as a pole having a given polarity of one of said permanent magnets is near said sensor;

a switch for activating said electromagnets by connecting said electromagnets to a source of electrical power; and a computer, said computer being capable of receiving input of a desired speed of rotation for said drive wheel, said computer being in communication with said sensor so that said computer receives a signal from said sensor only so long as a pole having a given polarity of one of said permanent magnets is near said sensor, said computer also being in communication with said switch in order to close said switch, said computer being capable of being programmed to produce a signal to close said switch periodically from a time a pole of the given polarity of one of said permanent magnets has approached said sensor until an opposite pole of said permanent magnet approaches said sensor, and said computer producing such a periodic signal to close said switch for a total period that the total period said switch is closed will create an average voltage that produces a desired speed of rotation for said drive wheel.

2. The motorized skate as recited in claim 1, wherein:

said computer has been further programmed to have the capability to invert the signal it sends to said switch.

3. The motorized skate as recited in claim 2, further comprising:

a module encapsulating one or more of said electromagnets, having a radiating surface, and containing a cavity that communicates thermally with both said electromagnets and the radiating surface so that a heat-transfer medium can be placed into such cavity, said module being removably insertable into said structure.

4. The motorized skate as recited in claim 3, further comprising:

a receiver in communication with said computer; and a remote control for receiving inputs of desired commands for the skate, said remote control having a means for communicating with and transmitting such inputs to said receiver.

5. The motorized skate as recited in claim 4, wherein:

said remote further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

6. The motorized skate as recited in claim 4, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

7. The motorized skate as recited in claim 6, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

8. The motorized skate as recited in claim 2, wherein:

said structure contains a cavity that communicates with said electromagnets and can contain either a heat-transfer medium or a heat-absorbing medium.

9. The motorized skate as recited in claim 2, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

10. The motorized skate as recited in claim 9, further comprising:

a receiver in communication with said computer; and a remote control for receiving inputs of desired commands for the skate, said remote control having a means for communicating with and transmitting such inputs to said receiver.

11. The motorized skate as recited in claim 4, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

12. The motorized skate as recited in claim 10, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

13. The motorized skate as recited in claim 6, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

14. The motorized skate as recited in claim 13, further comprising:

a receiver in communication with said computer; and a remote control for receiving inputs of the desired commands for the skate, said remote control having a means for communicating with and transmitting such inputs to said receiver.

15. The motorized skate as recited in claim 14, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

16. The motorized skate as recited in claim 14, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

17. The motorized skate as recited in claim 16, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

18. The motorized skate as recited in claim 13, further comprising:

at least one radiating surface, said radiating surface communicating with said cavity.

19. The motorized skate as recited in claim 18, further comprising:

a receiver in communication with said computer; and a remote control for receiving inputs of the desired commands for the skate, said remote control having a means for communicating with and transmitting such inputs to said receiver.

20. The motorized skate as recited in claim 19, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

21. The motorized skate as recited in claim 19, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

22. The motorized skate as recited in claim 21, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

23. The motorized skate as recited in claim 1, further comprising:

a module encapsulating one or more of said electromagnets, having a radiating surface, and containing a cavity that communicates thermally with both said electromagnets and the radiating surface so that a heat-transfer medium can be placed into such cavity.

24. The motorized skate as recited in claim 23, further comprising:

a receiver in communication with said computer; and a remote control for receiving inputs of desired commands for the skate, said remote control having a means for communicating with and transmitting such inputs to said receiver.

25. The motorized skate as recited in claim 24, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

26. The motorized skate as recited in claim 24, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

27. The motorized skate as recited in claim 26, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

28. The motorized skate as recited in claim 1, wherein:

said structure contains a cavity that communicates with said electromagnets and can contain either a heat-transfer medium or a heat-absorbing medium.

29. The motorized skate as recited in claim 28, further comprising:

at least one radiating surface, said radiating surface communicating with said cavity.

30. The motorized skate as recited in claim 29, further comprising:

a receiver in communication with said computer; and a remote control for receiving inputs of desired commands for the skate, said remote control having a means for communicating with and transmitting such inputs to said receiver.

31. The motorized skate as recited in claim 30, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

32. The motorized skate as recited in claim 30, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

33. The motorized skate as recited in claim 32, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

34. The motorized skate as recited in claim 28, further comprising:

a receiver in communication with said computer; and a remote control for receiving inputs of desired commands for the skate, said remote control having a means for communicating with and transmitting such inputs to said receiver.

35. The motorized skate as recited in claim 34, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

36. The motorized skate as recited in claim 34, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

37. The motorized skate as recited in claim 36, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

38. The motorized skate as recited in claim 1, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

39. The motorized skate as recited in claim 38, further comprising:

a receiver in communication with said computer; and a remote control for receiving inputs of desired commands for the skate, said remote control having a means for communicating with and transmitting such inputs to said receiver.

40. The motorized skate as recited in claim 39, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

41. The motorized skate as recited in claim 39, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

42. The motorized skate as recited in claim 41, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

43. The motorized skate as recited in claim 1, further comprising:

a receiver in communication with said computer; and a remote control for receiving inputs of desired commands for the skate, said remote control having a means for communicating with and transmitting such inputs to said receiver.

44. The motorized skate as recited in claim 43, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

45. The motorized skate as recited in claim 43, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

46. The motorized skate as recited in claim 45, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

47. The motorized skate as recited in claim 45, wherein:

said communicating means of the remote control further comprises a radio frequency receiver electrically connected to said conductor;

said remote control further comprises a visual display, communicating with the receiver portion of said radio frequency transmitter, to show selected values for operational parameters and current status for such operational parameters of the skate;

said computer is programmed to transmit to said remote control a signal containing the current status for the operational parameters of the skate; and said motorized skate further comprises a radio transmitter electrically connected to said second wide conductor.

48. The motorized skate as recited in claim 43, wherein:

said computer has been further programmed to have the capability to invert the signal it sends to said switch.

49. The motorized skate as recited in claim 48, wherein:

said remote control further comprises a means for receiving communications;

said remote control further comprises a visual display, communicating with the receiver portion of said remote control, to show the selected values for the operational parameters and the current status for such operational parameters of the skate;

said computer is programmed to transmit to said remote control a signal containing the current status for the operational parameters of the skate; and the skate further comprises a transmitter, said transmitter communicating with said computer, to send, at the direction of said computer, the signal from said computer to said remote control.

50. The motorized skate as recited in claim 48, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

51. A motorized skate, which comprises:

a means for retaining a foot of a user;

a drive wheel;

a rail to which said drive wheel is rotatably attached and to which said foot retaining means is attached;

one or more permanent magnets attached to said drive wheel with opposite magnetic poles adjacent to one another;

one or more electromagnets attached to said rail and arranged generally in a plane that is substantially parallel to each plane containing said permanent magnets, said electromagnets being sufficiently close to said permanent magnets that the magnetic fields of said electromagnets and said permanent magnets will interact with one another;

a sensor that produces a signal only so long as a pole, having a given polarity, of one of said permanent magnets is near said sensor;

a switch for activating said electromagnets by connecting said electromagnets to a source of electrical power;

a timing circuit, said timing circuit having an electronic component to establish period and being in communication with said sensor, said timing circuit also being in communication with said switch in order to close said switch, said timing circuit producing a periodic signal to close said switch only while said sensor produces a signal, and said timing circuit producing a periodic signal to close such switch for a period wherein the total period said switch is closed is fixed by the value of the electronic component within said timing circuit; and a computer in communication with said timing circuit.

52. The motorized skate as recited in claim 51, further comprising:

an inverter, said inverter being in communication with said computer and being electronically inserted by said computer between said sensor and said computer, for causing an inversion of an electronic signal that is sent from said sensor to said computer.

53. The motorized skate as recited in claim 52, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

54. The motorized skate as recited in claim 53, further comprising:

a receiver in communication with said computer; and a remote control for receiving inputs of the desired commands for the skate, said remote control having a means for communicating with and transmitting such inputs to said receiver.

55. The motorized skate as recited in claim 54, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

56. The motorized skate as recited in claim 52, further comprising:

a module encapsulating one or more of said electromagnets, having a radiating surface, and containing a cavity that communicates thermally with both said electromagnets and the radiating surface so that a heat-transfer medium can be placed into such cavity, said module being removably insertable into said structure.

57. The motorized skate as recited in claim 56, further comprising:

a receiver in communication with said computer; and a remote control for receiving inputs of desired commands for the skate, said remote control having a means for communicating with and transmitting such inputs to said receiver.

58. The motorized skate as recited in claim 57, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

59. The motorized skate as recited in claim 52, wherein:

said structure contains a cavity that communicates with said electromagnets and can contain either a heat-transfer medium or a heat-absorbing medium.

60. The motorized skate as recited in claim 59, further comprising:

a receiver in communication with said computer; and a remote control for receiving inputs of desired commands for the skate, said remote control having a means for communicating with and transmitting such inputs to said receiver.

61. The motorized skate as recited in claim 60, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

62. The motorized skate as recited in claim 61, wherein:

said structure contains a cavity that communicates with said electromagnets and can contain either a heat-transfer medium or a heat-absorbing medium.

63. The motorized skate as recited in claim 62, further comprising:

a receiver in communication with said computer; and a remote control for receiving inputs of desired commands for the skate, said remote control having a means for communicating with and transmitting such inputs to said receiver.

64. The motorized skate as recited in claim 63, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

65. The motorized skate as recited in claim 62, further comprising:

at least one radiating surface, said radiating surface communicating with said cavity.

66. The motorized skate as recited in claim 65, further comprising:

a receiver in communication with said computer; and a remote control for receiving inputs of desired commands for the skate, said remote control having a means for communicating with and transmitting such inputs to said receiver.

67. The motorized skate as recited in claim 66, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

68. The motorized skate as recited in claim 59, further comprising:

at least one radiating surface, said radiating surface communicating with said cavity.

69. The motorized skate as recited in claim 68, farther comprising:

a receiver in communication with said computer; and a remote control for receiving inputs of desired commands for the skate, said remote control having a means for communicating with and transmitting such inputs to said receiver.

70. The motorized skate as recited in claim 69, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

71. The motorized skate as recited in claim 51, further comprising:

a module encapsulating one or more of said electromagnets, having a radiating surface, and containing a cavity that communicates thermally with both said electromagnets and the radiating surface so that a heat-transfer medium can be placed into such cavity, said module being removably insertable into said structure.

72. The motorized skate as recited in claim 71, further comprising:

a receiver in communication with said computer; and a remote control for receiving inputs of desired commands for the skate, said remote control having a means for communicating with and transmitting such inputs to said receiver.

73. The motorized skate as recited in claim 72, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

74. The motorized skate as recited in claim 51, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

75. The motorized skate as recited in claim 74, further comprising:

a receiver in communication with said computer; and a remote control for receiving inputs of desired commands for the skate, said remote control having a means for communicating with and transmitting such inputs to said receiver.

76. The motorized skate as recited in claim 75, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

77. The motorized skate as recited in claim 51, further comprising:

a receiver in communication with said computer; and a remote control for receiving inputs of desired commands for the skate, said remote control having a means for communicating with and transmitting such inputs to said receiver.

78. The motorized skate as recited in claim 77, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

79. The motorized skate as recited in claim 77, further comprising:

an inverter, said inverter being in communication with said computer and being electronically inserted by said computer between said sensor and said computer, for causing an inversion of an electronic signal that is sent from said sensor to said computer.

80. The motorized skate as recited in claim 79, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

81. A motorized skate, which comprises:

a means for retaining a foot of a user;

a drive wheel;

a rail to which said drive wheel is rotatably attached and to which said foot retaining means is attached;

one or more permanent magnets attached to said drive wheel with opposite magnetic poles adjacent to one another;

one or more electromagnets attached to said rail and arranged generally in a plane that is substantially parallel to each plane containing said permanent magnets, said electromagnets being sufficiently close to said permanent magnets that the magnetic fields of said electromagnets and said permanent magnets will interact with one another;

a sensor that produces a signal only so long as a pole, having a given polarity, of one of said permanent magnets is near said sensor;

a switch for activating said electromagnets by connecting said electromagnets to a source of electrical power, said switch being in communication with said sensor and said switch being closed when and only when said switch receives a signal from said sensor; and a computer.

82. The motorized skate as recited in claim 81, further comprising:

an inverter, said inverter being in communication with said computer and being electronically inserted by said computer between said sensor and said computer, for causing an inversion of an electronic signal that is sent from said sensor to said computer.

83. The motorized skate as recited in claim 82, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

84. The motorized skate as recited in claim 83, further comprising:

a receiver in communication with said computer; and a remote control for receiving inputs of the desired commands for the skate, said remote control having a means for communicating with and transmitting such inputs to said receiver.

85. The motorized skate as recited in claim 84, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

86. The motorized skate as recited in claim 82, further comprising:

a module encapsulating one or more of said electromagnets, having a radiating surface, and containing a cavity that communicates thermally with both said electromagnets and the radiating surface so that a heat-transfer medium can be placed into such cavity, said module being removably insertable into said structure.

87. The motorized skate as recited in claim 86, further comprising:

a receiver in communication with said computer; and a remote control for receiving inputs of desired commands for the skate, said remote control having a means for communicating with and transmitting such inputs to said receiver.

88. The motorized skate as recited in claim 87, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

89. The motorized skate as recited in claim 82, wherein:

said structure contains a cavity that communicates with said electromagnets and can contain either a heat-transfer medium or a heat-absorbing medium.

90. The motorized skate as recited in claim 89, further comprising:

a receiver in communication with said computer; and a remote control for receiving inputs of desired commands for the skate, said remote control having a means for communicating with and transmitting such inputs to said receiver.

91. The motorized skate as recited in claim 90, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

92. The motorized skate as recited in claim 89, further comprising:

at least one radiating surface, said radiating surface communicating with said cavity.

93. The motorized skate as recited in claim 92, further comprising:

a receiver in communication with said computer; and a remote control for receiving inputs of desired commands for the skate, said remote control having a means for communicating with and transmitting such inputs to said receiver.

94. The motorized skate as recited in claim 93, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

95. The motorized skate as recited in claim 81, further comprising:

a module encapsulating one or more of said electromagnets, having a radiating surface, and containing a cavity that communicates thermally with both said electromagnets and the radiating surface so that a heat-transfer medium can be placed into such cavity, said module being removably insertable into said structure.

96. The motorized skate as recited in claim 95, further comprising:

a receiver in communication with said computer; and a remote control for receiving inputs of desired commands for the skate, said remote control having a means for communicating with and transmitting such inputs to said receiver.

97. The motorized skate as recited in claim 96, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

98. The motorized skate as recited in claim 81, wherein:

said structure contains a cavity that communicates with said electromagnets and can contain either a heat-transfer medium or a heat-absorbing medium.

99. The motorized skate as recited in claim 98, further comprising:

a receiver in communication with said computer; and a remote control for receiving inputs of desired commands for the skate, said remote control having a means for communicating with and transmitting such inputs to said receiver.

100. The motorized skate as recited in claim 99, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

101. The motorized skate as recited in claim 98, further comprising:

at least one radiating surface, said radiating surface communicating with said cavity.

102. The motorized skate as recited in claim 101, further comprising:

a receiver in communication with said computer; and a remote control for receiving inputs of desired commands for the skate, said remote control having a means for communicating with and transmitting such inputs to said receiver.

103. The motorized skate as recited in claim 102, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

104. The motorized skate as recited in claim 81, further comprising:

a magnetic pump containing a magnet, which magnetic pump is operated by interaction between said permanent magnets and the magnet in said magnetic pump;

a radiating heat sink; and a tube for transporting a cooling fluid from said magnetic pump, past said electromagnets, to said radiating heat sink, and back to said magnetic pump.

105. The motorized skate as recited in claim 104, further comprising:

a receiver in communication with said computer; and a remote control for receiving inputs of the desired commands for the skate, said remote control having a means for communicating with and transmitting such inputs to said receiver.

106. The motorized skate as recited in claim 105, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

107. The motorized skate as recited in claim 81, further comprising:

a receiver in communication with said computer; and a remote control for receiving inputs of the desired commands for the skate, said remote control having a means for communicating with and transmitting such inputs to said receiver.

108. The motorized skate as recited in claim 107, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

109. The motorized skate as recited in claim 107, further comprising:

an inverter, said inverter being in communication with said computer and being electronically inserted by said computer between said sensor and said computer, for causing an inversion of any electronic signal that is sent from said sensor to said computer.

110. The motorized skate as recited in claim 109, wherein:

said communicating means of the remote control comprises a radio frequency transmitter for accomplishing communication with said receiver; and a conductor electrically connected to said radio frequency transmitter; and said motorized skate further comprises a second conductor; and a radio frequency receiver, said radio frequency receiver communicating with said computer and said radio frequency receiver being electrically connected to said second conductor.

111. A process for motorizing a skate, which comprises:

rotatably attaching a drive wheel to a rail;

retaining a foot of a user on said rail;

attaching to said drive wheel one or more permanent magnets with opposite magnetic poles adjacent to one another;

attaching to said rail one or more electromagnets arranged generally in a plane that is substantially parallel to each plane containing said permanent magnets, said electromagnets being sufficiently close to said permanent magnets that magnetic fields of said electromagnets and said permanent magnets will interact with one another;

determining the location of said permanent magnets with a sensor;

connecting a switch for activating said electromagnets between said electromagnets and a source of electrical power;

inputting to a computer the desired speed of rotation for said drive wheel;

having said sensor produce a signal only so long as a pole having a given polarity of one of said permanent magnets is near said sensor;

connecting said computer to said switch;

programming said computer to produce a signal to close said switch periodically from the time a pole of one of said permanent magnets has approached said sensor until the opposite pole of said permanent magnet approaches said sensor; and producing with said computer such a periodic signal to close said switch so that the total period said switch is closed will create an average voltage that produces the desired speed of rotation for said drive wheel.

112. A process for motorizing a skate, which comprises:

rotatably attaching a drive wheel to a rail;

retaining a foot of a user on said rail;

attaching to said drive wheel one or more permanent magnets with opposite magnetic poles adjacent to one another;

attaching to said rail one or more electromagnets arranged generally in a plane that is substantially parallel to each plane containing said permanent magnets, said electromagnets being sufficiently close to said permanent magnets that the magnetic fields of said electromagnets and said permanent magnets will interact with one another;

producing a signal with as sensor that creates such current only so long as a pole, having a given polarity, of one of said permanent magnets is near said sensor;

connecting a switch for activating said electromagnets between said electromagnets and a source of electrical power;

connecting said sensor to a timing circuit having an electronic component to establish a period;

connecting said timing circuit to said switch; and producing with said timing circuit a periodic signal to close said switch only while said sensor produces a signal, wherein the total period for which said periodic signal closes said switch is fixed by the value of an electronic component within said timing circuit.

113. A process for motorizing a skate, which comprises:

rotatably attaching a drive wheel to a rail;

retaining a foot of a user on said rail;

attaching to said drive wheel one or more permanent magnets with opposite magnetic poles adjacent to one another;

attaching to said rail one or more electromagnets arranged generally in a plane that is substantially parallel to each plane containing said permanent magnets, said electromagnets being sufficiently close to said permanent magnets that magnetic fields of said electromagnets and said permanent magnets will interact with one another;

producing a voltage with a sensor that creates such voltage only so long as a pole, having a given polarity, of one of said permanent magnets is near said sensor;

connecting a switch between said electromagnets and a source of electrical power; and connecting said sensor to said switch so that said switch closes when and only when said switch receives voltage from said sensor.

114. A motorized skate, which comprises:

a means for retaining a foot of a user;

a drive wheel;

a rail to which said drive wheel is rotatably attached and to which said foot retaining means is attached;

one or more permanent magnets attached to said drive wheel with opposite magnetic poles adjacent to one another;

one or more electromagnets attached to said rail and arranged generally in a plane that is substantially parallel to each plane containing said permanent magnets, said electromagnets being sufficiently close to said permanent magnets that the magnetic fields of said electromagnets and said permanent magnets will interact with one another;

a sensor that produces a signal only so long as a pole, having a given polarity, of one of said permanent magnets is near said sensor;

a switch for activating said electromagnets by connecting said electromagnets to a source of electrical power; and a timing circuit, said timing circuit having an electronic component to establish period and being in communication with said sensor, said timing circuit also being in communication with said switch in order to close said switch, said timing circuit producing a periodic signal to close said switch only while said sensor produces a signal, and said timing circuit producing a periodic signal to close such switch for a period wherein the total period said switch is closed is fixed by the value of the electronic component within said timing circuit.

115. A motorized skate, which comprises:

a means for retaining a foot of a user;

a drive wheel;

a rail to which said drive wheel is rotatably attached and to which said foot retaining means is attached;

one or more permanent magnets attached to said drive wheel with opposite magnetic poles adjacent to one another;

one or more electromagnets attached to said rail and arranged generally in a plane that is substantially parallel to each plane containing said permanent magnets, said electromagnets being sufficiently close to said permanent magnets that the magnetic fields of said electromagnets and said permanent magnets will interact with one another;

a sensor that produces a signal only so long as a pole, having a given polarity, of one of said permanent magnets is near said sensor; and a switch for activating said electromagnets by connecting said electromagnets to a source of electrical power, said switch being in communication with said sensor and said switch being closed when and only when said switch receives a signal from said sensor.

* * * * *